US005175038A

United States Patent [19]

Tung et al.

[11] Patent Number: 5,175,038

[45] Date of Patent: Dec. 29, 1992

[54] CARPET YARNS AND CARPETS WITH IMPROVED BALANCE OF NEWNESS RETENTION AND BULK

[75] Inventors: Wae-Hai Tung, Seaford, Del.; Frank Werny, West Chester, Pa.

[73] Assignee: E. I. Du Pont de Nemours and Company, Wilmington, Del.

[21] Appl. No.: 579,911

[22] Filed: Sep. 7, 1990

[51] Int. Cl.[5] ..... D02G 3/02; D02G 3/36; B32B 3/02; B32B 33/00

[52] U.S. Cl. ..... 428/92; 428/97; 428/369; 428/397; 428/401; 57/205; 57/237; 57/247

[58] Field of Search ..... 428/92, 97, 397, 401, 428/369; 57/205, 237, 247

[56] References Cited

U.S. PATENT DOCUMENTS

| | | | |
|---|---|---|---|
| 2,939,201 | 6/1960 | Holland | 428/397 X |
| 3,164,949 | 1/1965 | Pitzl | 428/397 X |
| 3,469,387 | 6/1967 | Chamberlain et al. | 57/156 |
| 3,831,368 | 8/1974 | Glowacki | 57/157 |
| 3,900,623 | 8/1975 | Hatt | 428/92 |
| 4,001,369 | 1/1977 | Shah | 428/397 X |
| 4,295,252 | 10/1981 | Robinson | 28/248 |
| 4,452,160 | 6/1984 | Tajiri et al. | 57/205 X |
| 4,472,481 | 9/1984 | Snooks, Jr. et al. | 428/397 X |
| 4,492,731 | 1/1985 | Bankar et al. | 428/397 X |
| 4,802,330 | 2/1989 | Yngve et al. | 57/238 |
| 4,839,211 | 6/1989 | Wilkie et al. | 428/97 |
| 4,871,604 | 10/1989 | Hackler | 428/96 |
| 4,882,222 | 11/1989 | Talley, Jr. et al. | 428/97 |

FOREIGN PATENT DOCUMENTS

| | | |
|---|---|---|
| 224831 | 11/1985 | Japan . |
| 60-224831 | 11/1985 | Japan . |
| WO88/03969 | 6/1988 | PCT Int'l Appl. . |
| 2205116A | 11/1988 | United Kingdom . |

*Primary Examiner*—George F. Lesmes
*Assistant Examiner*—Terrel Morris

[57] ABSTRACT

Bulked continuous filament carpet yarns having high levels of bulk are disclosed. When ply-twisted together at unusually high twist levels and tufted into carpets, such yarns produce cut-pile carpets having a superior balance of carpet bulk and newness retention when compared to carpets of identical construction made with yarns having conventional levels of yarn bulk and/or twist.

12 Claims, 7 Drawing Sheets

CARPET YARNS AND CARPETS WITH IMPROVED BALANCE OF NEWNESS RETENTION AND BULK

TECHNICAL FIELD

The present invention relates to highly bulked continuous filament yarns which can be ply-twisted together at high-twist levels and tufted into cut-pile carpets which exhibit a superior balance of newness retention and carpet bulk.

BACKGROUND OF THE INVENTION

The great majority of residential carpets sold in the United States use synthetic polymeric pile yarns in a construction known as saxony. Two or more nylon, polyester, or polypropylene crimped "singles" yarns are twisted together and set in the ply-twisted configuration either in saturated steam or in dry heat, and such twisted yarns are tufted into a primary carpet backing and cut to form a cut-pile. The carpet is then dyed in an aqueous bath near 100° C. or on a continuous dye range, rinsed and dried. A latex adhesive is applied to the underside of all tufted carpets to retain the tufts in position, and the tufts are then sheared to a uniform pile height.

Cut-pile saxony carpets made from synthetic fibers have excellent bulk and durability versus similar carpets made from natural fibers such as wool. Carpet yarns comprised of synthetic fibers typically have higher bulk than carpet yarns comprised of natural fibers, making it possible to produce carpets from synthetic fibers having higher bulk at lower face weight than carpets made from natural fibers.

In a new cut-pile saxony carpet, each ply-twisted yarn is seen as an individual tuft, and the tufts are said to have "pencil point" or "pin point" definition. However, as the carpet becomes worn, the plied yarn components begin to untwist and the individual filaments in each yarn separate from the bundle and intermingle with those from neighboring tufts. As this process progresses, the tufts are no longer seen as individuals and the surface of the carpet takes on a matted appearance. The contrast between a high-traffic, matted portion of a carpet and a low-traffic portion (near furniture, for example) which has retained its tuft definition, becomes undesirable. Therefore, appearance or newness retention is a carpet property on which consumers place considerable value in that carpets with poor wear properties must be replaced more frequently.

Several methods for improving the wear properties of carpets have been disclosed in the art. Hatt U.S. Pat. No. 3,900,623 describes carpets having a cut-pile in which the filaments in the tufts become unwound and entangled at the tips to form strong coherent tufts. Wilkie & Talley U.S. Pat. Nos. 4,839,211 and 4,882,222 disclose saxony carpets made from blends of conventional and high shrinkage fibers which have improved appearance retention properties when compared to saxony carpets of the same construction without the high shrinkage fibers. The use of heat-activated binder fibers in carpet yarns to improve retention of tuft identity is disclosed in the published patent applications Sekiya JP Kokai 60-224,831, Hackler PCT-WO 88/03969, and Watt & Fowler GB 2205116-A. The binder fibers melt during twist-setting or latexing operations and bond the filaments of the yarn together, resulting in improved twist retention and enhanced wear properties. Hackler, U.S. Pat. No. 4,871,604 describes carpets in which the pile yarn has been coated with a heat-activated binder fiber powder resulting in improved wear performance. Binder fibers and binder powders, however, tend to give the finished carpet an undesirably harsh hand.

Appearance retention and bulk in conventional cut-pile carpets are related to various yarn properties and carpet construction parameters, the most important of these being the yarn modification ratio, yarn bulk, denier per filament (dpf), total yarn denier, degree of ply twist, carpet pile height and pile weight. Other variables that may affect carpet appearance retention include dyeing method, heatsetting method, type of backing, and whether or not padding is used under the installed carpet. Hollow-filament yarns of rectangular-shaped cross-sections which have yarn bulk values as high as 30–35 are made and used for commercial carpet constructions which are characterized by having high pile densities (greater than 4000 oz/yd$^3$), where pile density is calculated by dividing the weight of the carpet in ounces per square yard by the pile height measured in inches, and multiplying by 36. Such yarns are not suitable for cut-pile residential carpets, however, where pile densities are typically much lower (less than 3600 oz/yd$^3$). Yarn bulk values (% bulk crimp elongation, as measured and described hereinafter) for trilobal cross-section yarns used in residential cut-pile carpets have not exceeded 20–25 because, typically, initial appearance is poor and as yarn bulk or carpet bulk increases, newness retention decreases. For these reasons, no effort has been made to produce yarns having extremely high bulk values which are suitable for use in residential cut-pile carpets.

One method for improving newness retention is to increase ply twist levels. However, with current carpet yarns, increasing the ply twist to high levels results in a significant reduction in carpet bulk, giving the carpet a "lean" appearance and undesirable hand, thus requiring significantly increased pile weight in order to obtain an aesthetically acceptable carpet.

The current invention provides carpet yarns having new levels of high bulk which when ply-twisted at high twist levels and tufted into cut-pile saxony carpets yield carpets having an improved balance of bulk and appearance retention versus prior art carpets of equal carpet construction. While addition of high twist is known to reduce carpet bulk and improve appearance retention proportionately, we have found that high bulk yarns, while they also lose bulk and gain newness retention upon twisting, achieve a better balance of bulk and newness retention than lower bulk conventional yarns. Thus, the current invention involves carpet yarns having new, high levels of bulk ply-twisted together at unusually high twist levels. Carpets tufted from such yarns surprisingly exhibit an improved and high level of newness retention and bulk when compared with carpets of equal construction made with yarns of conventional bulk and twist levels.

SUMMARY OF THE INVENTION

The high bulk yarns of the present invention include bulked continuous filament nylon yarns comprised of filaments having a denier per filament of 10–25 and a trilobal filament cross-section of modification ratio between 1.4 and 4.0, the yarn having a relationship between bulk level and modification ratio corresponding to a point above line A on FIG. 1. They further include bulked continuous filament nylon yarns, irrespective of filament cross-section, which have a yarn bulk level of at least 35.

The ply-twisted yarns of this invention include ply-twisted yarns comprised of two to four bulked continuous filament nylon ply yarns each having a denier per filament of 10–25 and a trilobal filament cross-section of modification ratio between 1.4 and 4.0 wherein the relationship between bulk level and modification ratio for each of the plies corresponds to a point above line A on FIG. 1 and wherein the relationship between twist level and modification ratio corresponds to a point on or above line E or, preferably line F, as shown on FIG. 2. Particularly useful in making carpets with excellent properties are those ply-twisted yarns wherein each ply corresponds to a point above line B or line C on FIG. 1 and where the relationship between twist level and modification ratio corresponds to a point on or above line E or, even more preferably, line F shown on FIG. 2.

Cut-pile carpets made from these high-bulk, high-twist yarns exhibit a superior combination of newness retention and carpet bulk when compared to carpets of the same construction having conventional levels of bulk and/or twist. These properties are observed in carpets throughout the entire range of pile weights typically used in residential applications, i.e. from very low weights such as 20 oz/yd$^2$ (0.68 kg/m$^2$) up through "upper end" constructions having 50 oz/yd$^2$ (1.70 kg/m$^2$) or more. Similarly, such properties are found in cut-pile constructions having pile heights of 7/16 inch (1.11 cm) or more.

While the figures and examples discussed hereinafter relate to nylon 6,6 yarns and carpets, other polymers useful in residential carpet applications, notably other nylons such as nylon 6 and nylon copolymers, polyester, polypropylene and their copolymers may similarly be used. Appropriate adjustments would, of course, be required for the bulk levels and newness retention values shown in these figures.

DETAILED DESCRIPTION

The carpet yarns of the current invention have bulk levels higher than those previously available in the art. The relationship between bulk level and modification ratio (MR) for the trilobal yarns of the invention is detailed in FIG. 1. The bulk levels were measured using the process of Robinson & Thompson, U.S. Pat. No. 4,295,252 which is described below. Yarns having deniers of approximately 800–2000 and denier per filament (dpf) of approximately 10–25 and comprised of fibers having trilobal cross sections with MR values of 1.4 to 4.0 are useful in the current invention. MR values of 1.4 to 2.8 are preferred for use in making carpets with high levels of newness retention.

The area below line A depicts the range of bulk levels for typical trilobal residential carpet yarns present in the marketplace prior to the current invention. As can be seen, yarn bulk level tends to decrease as modification ratio increases. Line A itself, with bulk levels of 20–25, depending on modification ratio, represents the previous upper limit for bulk in trilobal carpet yarns. Hollow filament yarns having square cross sections, with typical bulk levels up to as high as about 30–35 have been used in high pile density commercial carpet constructions. The yarns of the current invention have bulk levels corresponding to points lying above line A. Lines B and C correspond to yarns of the current invention for different process conditions which are described more fully in the Examples below.

Figure 2:
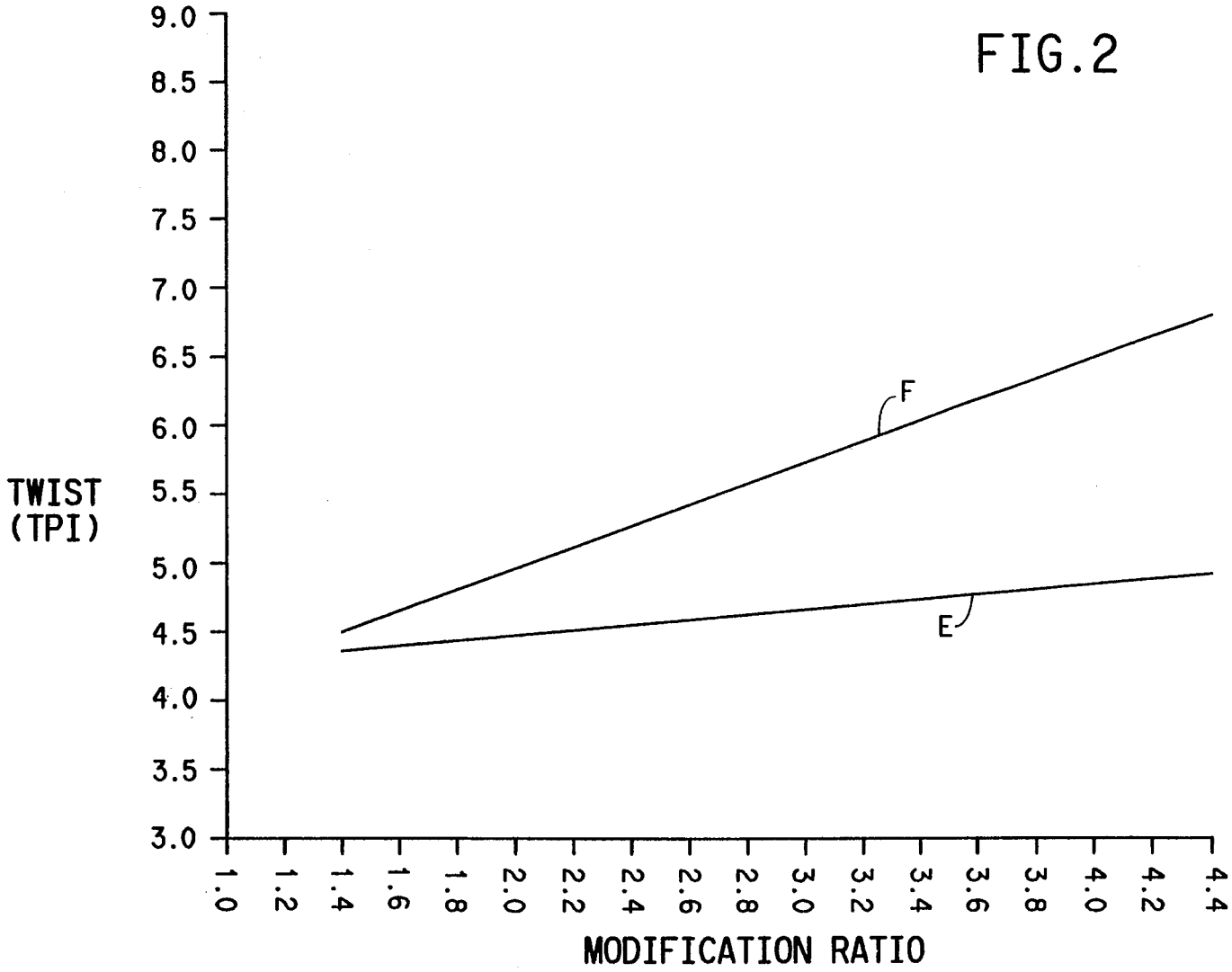
FIG. 2 is a plot of yarn twist level as it relates to modification ratio setting forth lower twist limits for ply-twist yarns of the invention.

It has been found that using two or more, though preferably two, of the high bulk singles yarns of the current invention and twisting them together at high twist levels produces ply-twist yarns which can be tufted into carpets having an improved balance of carpet bulk and newness retention over carpets of the same construction tufted from yarns of lower bulk and/or lower twist. The bulked yarns are ply-twisted using conventional methods known in the art prior to tufting into carpets. The degree of twist required in order to achieve the desired balance of properties in the tufted carpet depends on the modification ratio of the yarn. Typically, yarns having higher modification ratios require more twist in order to obtain good carpet performance. FIG. 2 is a plot of twist versus modification ratio. Twist levels corresponding to points on or above line E shown in FIG. 2 are required in order to produce the twisted yarns of the current invention which when tufted into cut-pile carpets have the desired balance of carpet bulk and newness retention. Twist levels corresponding to points on or above line F in FIG. 2 are preferred to provide carpets having superior newness retention (at least 2.5) while still exhibiting good bulk. Twist levels of as high as 7 tpi (2.8 twists/cm) have been shown to produce carpets having excellent properties.

While typically each yarn bundle has filaments of identical cross-section and two or more such identical yarns are ply-twisted together, singles yarns having mixed modification ratios or ply-twisted yarns made from singles yarns having different modification ratios are also considered to be within the scope of the present invention. In such cases, the modification ratio should be considered to be the weighted average of the modification ratios of all the filaments in the singles or ply-twisted yarn.

Figure 3:
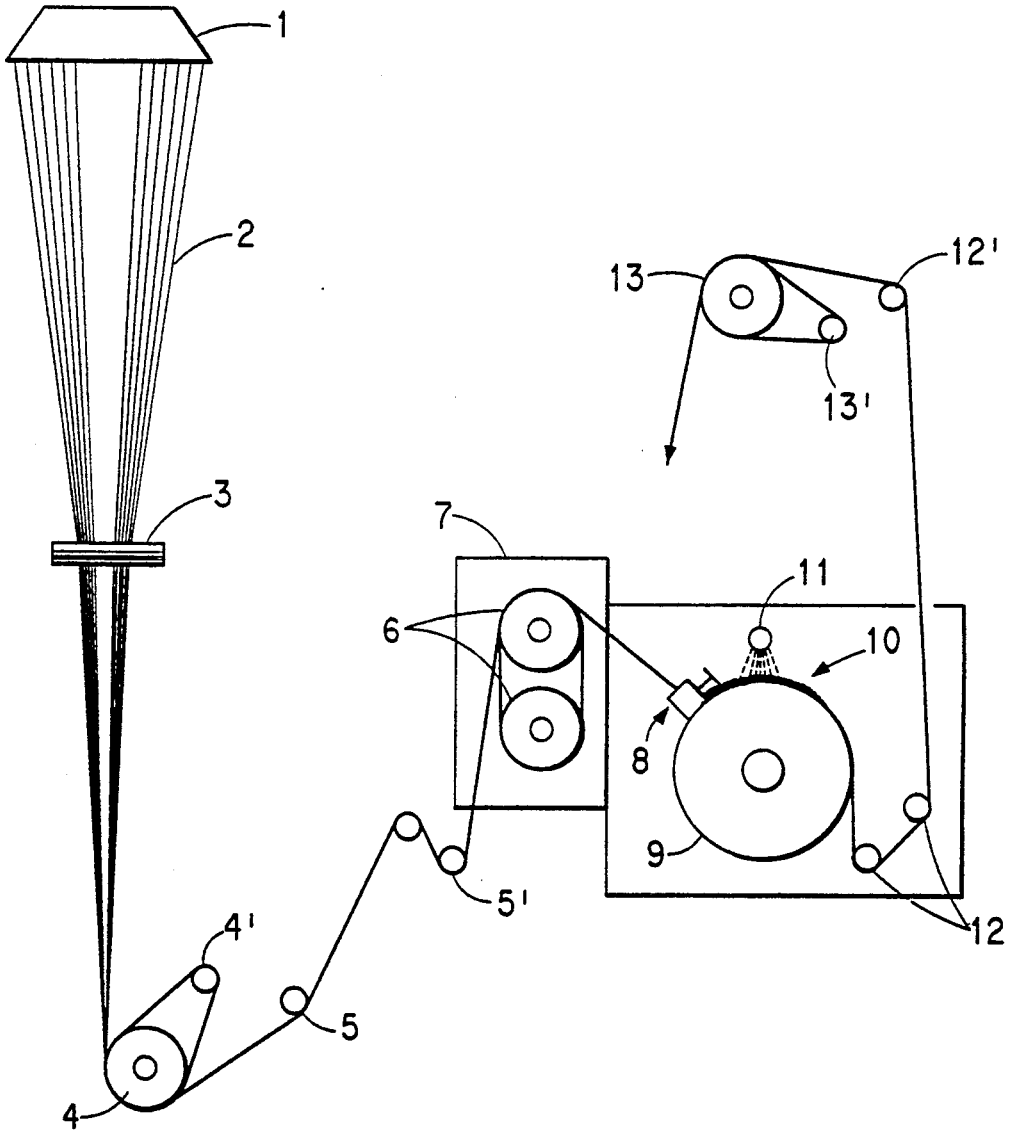
FIG. 3 is a schematic depiction of the process used for making the high bulk yarns described herein.

A spinning and bulking apparatus useful in preparing the yarns of the current invention is outlined in FIG. 3. The polymer is spun at temperatures of from about 300°

C. using a spinneret assembly 1 into a quench zone where they are rapidly quenched at 2 using cross-flow air (4–21° C.). After quenching, the filaments are treated with finish by contacting finish roller 3 which is partially immersed in a finish trough (not shown). The yarn is then wrapped around motor-driven feed roll 4 and its associated separator roll 4', passed around draw pin assembly 5,5' and then wrapped around draw rolls 6 (internally heated to produce a surface temperature of from 200° to 220° C. and enclosed in a hot chest 7) and stretched to from two to four times its original length before entering the bulking jet 8. The yarn is crimped in jet 8 using air which is heated to 200–240° C. and exits the jet to impinge upon a rotating drum 9 which has a perforated surface on which the yarn cools in the form of a bulky caterpillar 10 to set the crimp. Cooling of the yarn is facilitated by pulling a vacuum through the perforated drum and using a room-temperature water mist quench 11 (typically 80±20 ml/threadline/min). Chilled water may also be used for more effective cooling. From the drum, the threadline passes under stationary pin assembly 12,12' to motor-driven takeup roll 13 and its associated separator roll 13'. The speed of takeup roll 13 is adjusted to maintain the caterpillar 10 at the desired length by changing the take off point from the drum. The caterpillar take off point is also controlled by the position of pins 12. The residence time of the yarn on the bulking drum is controlled by the length of the caterpillar, with longer residence times resulting in better cooling of the yarn and higher bulk in the final yarn product. The yarn then proceeds to a winder where it is wound in the desired package configuration.

The above conditions are useful in spinning nylon 6,6 yarns. Other polyamides and polymers such as polypropylene or polyester may be spun in a similar process, however the temperatures used will differ due to the different melting points of the various polymers. Other variations to the above-described apparatus and spinning process may be envisioned by those skilled in the art.

In general, increasing hot roll and bulking air temperatures results in yarns having increased bulk. However, the higher the bulking temperature, the more difficult it is to set the crimp. It is important to cool the yarn sufficiently in order to achieve high bulk in the final yarn product. The mist quench and residence time of the yarn on the rotating drum are important factors determining the degree of cooling. It is possible to achieve higher yarn bulk levels for yarns having higher denier per filament (dpf). Low dpf filaments have lower crimping force and the crimp is more easily pulled out during the winding process. The nature of the finish used may also have a small effect on the bulk level obtained, with low-friction ethoxylated ester-type finishes tending to result in increased bulk.

TEST METHODS

Yarn bulk was measured using the method described in Robinson & Thompson U.S. Pat. No. 4,295,252. Unless otherwise indicated, yarn bulk levels are reported herein as % bulk crimp elongation (% BCE) as described in Robinson & Thompson. The bulk measurements were made at 11 m/min for 1.5 minutes using a sample length of 16.5 meters. The tensioning weight used was 0.1 gram/denier (0.11 g/dtex). The pressure of the air in the heating chamber was 0.05 inches of water, and the temperature of the heating air was 170±3° C.

An alternate method which may be used to measure yarn bulk levels is percent yarn crimp elongation (% YCE). This method will be particularly useful for polymers other than nylon 6,6 in that the properties of such other polymers would require temperature adjustments to the process for measuring % BCE as set forth in the Robinson & Thompson patent. In this method, each of three relaxed yarn specimens approximately 1 meter in length are extended manually until just taut and then coiled. 2.5 liters of water are placed in a 12 liter bucket and brought to an active boil. A brass sieve, U.S. Sieve Series No. 10 with 2.00 mm openings, Tyler equivalent 9 mesh, is placed into the boiling water. The yarn specimens are uncoiled and dropped slowly into the boiling water and left for 1–2 minutes. The sieve is removed from the boiling water and placed in a bucket of cold water for 0.5 minute. The yarn samples are then removed and blotted gently between paper towels to remove excess moisture. The specimens are then placed into aluminum foil cups and dried in an oven at 105 (±5) degrees C. for 1 hour. The specimens are conditioned at 70 (±2) degrees F. (21±1° C.) and 65 (±2) % relative humidity for a minimum of 2 hours before testing. The specimens are separated and one end of a specimen taped to the inner surface of a toggle clamp which is mounted 50 cm above the zero line of a vertically mounted meter stick. The specimen is allowed to hang freely and cut at the 55 cm mark. A small piece of ¼ inch (0.64 cm) masking tape is wrapped around the yarn so that it coincides with the zero line on the meter stick. For yarn deniers below 1300 denier (1444 dtex), a 125 gram weight is used. For other deniers, a weight equal to 0.1 g/denier is used. The weight is clamped onto the yarn so that the tape tab is just inside the clamp and the weight lowered so that the yarn specimen just supports the total load. The specimen is allowed to hang for a minimum of 3 minutes and the extended length (specimen elongation) is measured at the top edge of the masking tape. The process is repeated for each of the additional specimens. The percent yarn crimp elongation = % YCE is calculated as (specimen elongation/50 cm)×100. % YCE values are typically determined using the average value of the three specimens. % YCE may be converted into % BCE using the equation % YCE = (0.96) % BCE + 4.9.

Modification ratio is as defined and measured in Bankar et al., U.S. Pat. No. 4,492,731, the disclosure of which is incorporated herein by reference.

Carpet bulk was measured as the compressed pile height in inches of a carpet sample that is loaded with a pressure of 1 lb/in$^2$ (703 kg/m$^2$). The carpet sample is placed on a platform which is attached to a vibrator which vibrates the sample lightly for 10 seconds prior to measuring the pile height using a thickness gauge, which is also attached to the vibrating platform. The vibration allows the foot of the thickness gauge to settle into the surface of the carpet.

Carpet appearance retention may be measured by subjecting a carpet to a specified number of human traffics and visually determining a rating based on the degree of matting versus a control sample. Wear tests which closely correlate to floor trafficking were conducted in a Vetterman drum test apparatus, Type KSG manufactured by Schoenberg & Co. (Baumberg, Fed. Rep. of Germany), according to ISO (International Standards Organization) document TC38/12/WG 6 N 48. As specified, the drum is lined with carpet samples with the pile facing inwards and contains a steel ball having fourteen (14) rubber buffers which rolls randomly inside the rotating drum. A circular brush within the drum is in light contact with the carpet surface and removes loose pile fibers which are continuously removed by suction. After 20,000 cycles, the samples are removed and inspected to evaluate texture retention. Texture retention is reported on a scale of 1–5 with a rating of 5 corresponding to an untested control sample, 4 corresponding to a lightly worn sample, 3 to a moderately worn sample, 2.5 to the turning point from acceptable to unacceptable wear, a rating of 2 corresponding to clearly unacceptable wear, and 1 corresponding to an extremely matted control sample.

EXAMPLES

EXAMPLES 1–3

Nylon 6,6 polymer with 70 relative viscosity (RV) was spun at 290° C. through a 160 hole 1.75 modification ratio (MR) spinneret at 73 lb/hr (33 kg/hr) throughput. The extruded filaments were separated into two 80 filament bundles and were quenched by 300 cubic ft/min (8.5 cubic meters/min) of chilled cross-flow air at 48° F. (9° C.) in a chimney approximately 6 ft (1.8 m) long. The filaments were coated with a low-friction, ethoxylated ester-type lubricant and pulled by a rotating feed roll at 853 ypm (775 m/min). The two filament bundles were drawn by a pair of heated draw rolls operating at 2388 ypm (2171 m/min). A set of stainless steel draw pins was used between the feed roll and the draw rolls to localize the draw point. The draw rolls were heated internally by condensing vapor to 170° C. The draw rolls serve to draw and heat the filament before jet/screen crimping. After making eight wraps around the draw rolls, each heated filament bundle was pulled by a separate dual-impingement bulking jet of the type described in Coon, U.S. Pat. No. 3,525,134, where 200° C., 100 psi (690 kPa) hot air was impinged on the filaments at a 30 degree angle to crimp and interlace the filaments. The crimped yarns were relaxed in a compact form (caterpillar) on a 15 in (0.38m) diameter perforated rotating drum at 60 rpm. The caterpillar was cooled by air on the bulking drum from the 11 to 1 o'clock position by pulling a vacuum of 10 inches of water on the drum and was then removed by a take-up roll at 2027 ypm (1853 m/min), and an additional lubricant was applied prior to winding on a package. The yarn produced in this example was 1220 denier (1356 dtex), 15 dpf (16.7 dtex/filament), had a modification ratio of 1.75 and a yarn bulk level (% BCE) of 23.

The BCF yarn of Example 2 was similar to Example 1 except that the draw roll temperature was raised to 210° C. The resulting yarn had a 1.75 MR cross section and a 38.5 yarn bulk level (% BCE).

The yarn of Example 3 was prepared in a similar process to Example 2 except that a 1.45 MR spinneret was used. The resulting yarn had a bulk level (% BCE) of 40.

The yarns produced in Examples 1–3 were converted into two-ply cable twisted yarns having 3.5, 4.5, 5.5 twist per inch (1.4, 1.8, and 2.2 twists/cm), heatset in a Superba heat-setting apparatus using saturated steam at 270° C. and tufted into ⅛ in 0.32 cm) gauge, 9/16 in (1.4 cm) pile height cut-pile carpets at 28 and 34 oz/sq yd (0.95 and 1.15 kg/m$^2$) and ⅝ in (1.6 cm) pile height at 40 oz/sq yd (1.36 kg/m$^2$). The tufted carpets were then dyed by passing though a Gaston County/Zima Fluidyer on a continuous carpet dyeing range. The carpet passed first through a Pad/Wet out bath at 100° F. (38° C.). It then passed through a dyebath at 80° F. (26.7° C.) and a pH of 6. The running speed of the carpet was 5 ypm (4.5 mpm) with a 100% wet-out pickup and a 350% wet pickup of dye. Pad squeeze out pressure was 45 lbs in the wet out bath, while in the Fluidyer the cushion pressure was 0.25 bar and the air pressure brake was 0.5 bar. The carpets then passed through a vertical steamer at 212° F. (100° C.) for 6 min. The wet carpets were then passed through a Flexnip to apply a fluorocarbon antisoil treatment and air dried at 250° F. (121° C.). The dry carpets were then oversprayed with an antistain treatment and dried again, followed by machine latexing, curing and shearing. The finished carpets were tested for carpet bulk and for newness retention (NR) in a Vetterman drum according to the procedures described above and subjectively rated for newness retention by a panel of experienced researchers. The test results are summarized in Table 1 below.

TABLE 1

| Item | MR | Yarn % BCE | Twist (tpi) | Carpet Wt (oz/sq yd) | Carpet Bulk | NR |
|---|---|---|---|---|---|---|
| 1 A | 1.75 | 23 | 3.5 | 28 | 0.282 | 2.3 |
| 1 A' | 1.75 | 23 | 3.5 | 34 | 0.321 | 2.5 |
| 1 A" | 1.75 | 23 | 3.5 | 40 | 0.375 | 2.7 |
| 1 B | 1.75 | 23 | 4.5 | 28 | 0.259 | 2.7 |
| 1 B' | 1.75 | 23 | 4.5 | 34 | 0.289 | 2.8 |
| 1 B" | 1.75 | 23 | 4.5 | 40 | 0.343 | 3.5 |
| 1 C | 1.75 | 23 | 5.5 | 28 | 0.224 | 3.0 |
| 1 C' | 1.75 | 23 | 5.5 | 34 | 0.253 | 3.4 |
| 1 C" | 1.75 | 23 | 5.5 | 40 | 0.292 | 4.0 |
| 2 A | 1.75 | 38 | 3.5 | 28 | 0.328 | 2.2 |
| 2 A' | 1.75 | 38 | 3.5 | 34 | 0.371 | 2.1 |
| 2 A" | 1.75 | 38 | 3.5 | 40 | 0.436 | 2.1 |
| 2 B | 1.75 | 38 | 4.5 | 28 | 0.296 | 2.6 |
| 2 B' | 1.75 | 38 | 4.5 | 34 | 0.348 | 2.5 |
| 2 B" | 1.75 | 38 | 4.5 | 40 | 0.409 | 2.7 |
| 2 C | 1.75 | 38 | 5.5 | 28 | 0.274 | 3.3 |
| 2 C' | 1.75 | 38 | 5.5 | 34 | 0.298 | 3.9 |
| 2 C" | 1.75 | 38 | 5.5 | 40 | 0.366 | 3.4 |
| 3 A | 1.45 | 40 | 3.5 | 28 | 0.312 | 2.0 |
| 3 A' | 1.45 | 40 | 3.5 | 34 | 0.360 | 2.1 |
| 3 A" | 1.45 | 40 | 3.5 | 40 | 0.438 | 2.2 |
| 3 B | 1.45 | 40 | 4.5 | 28 | 0.284 | 3.0 |
| 3 B' | 1.45 | 40 | 4.5 | 34 | 0.341 | 2.8 |
| 3 B" | 1.45 | 40 | 4.5 | 40 | 0.387 | 3.0 |
| 3 C | 1.45 | 40 | 5.5 | 28 | 0.256 | 3.7 |
| 3 C' | 1.45 | 40 | 5.5 | 34 | 0.294 | 3.6 |
| 3 C" | 1.45 | 40 | 5.5 | 40 | 0.340 | 3.7 |

Figure 4:
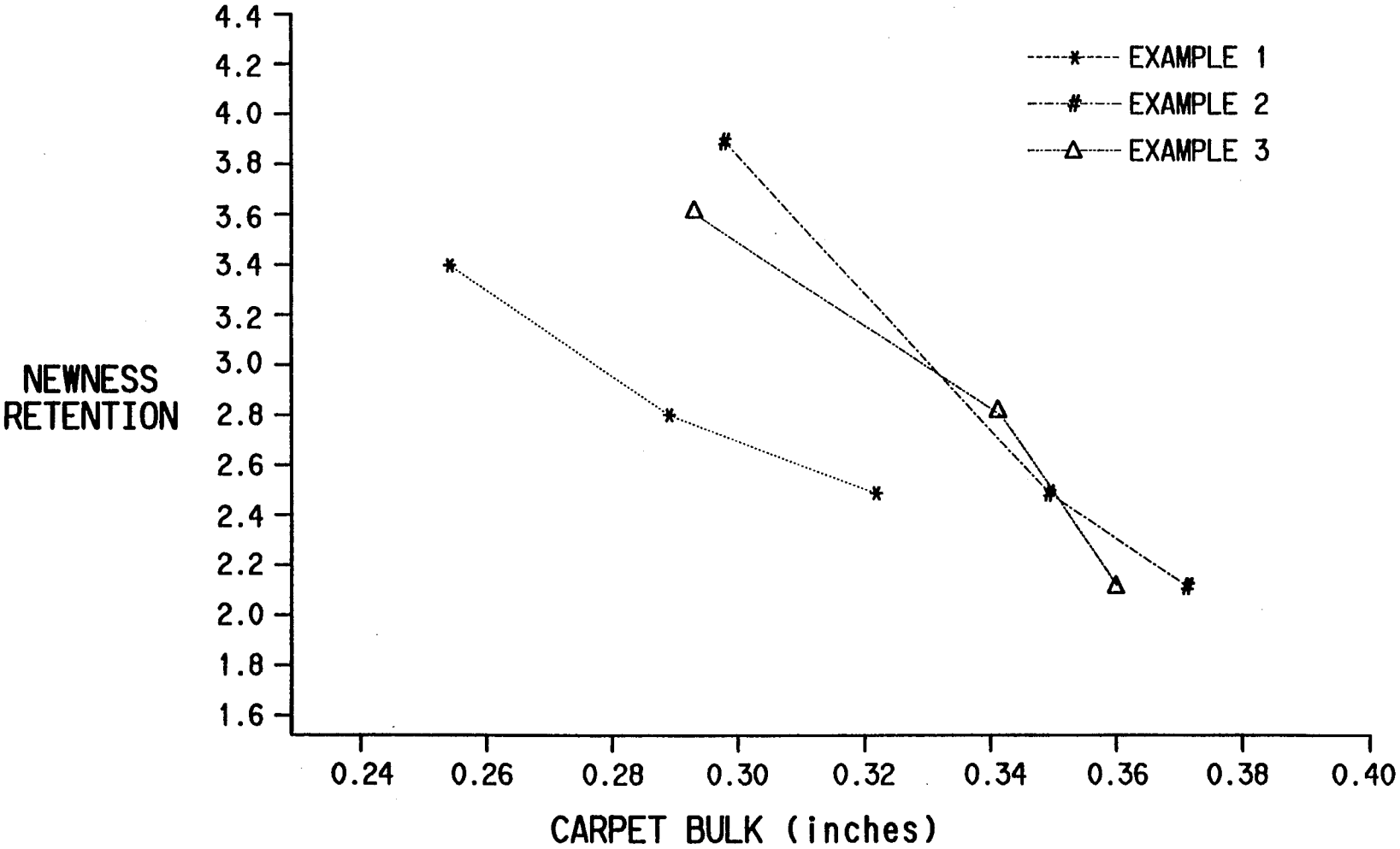
FIG. 4 is a plot of newness retention as it relates to carpet bulk, showing the balance of properties for various carpets having 34 oz/yd$^2$ (1.15 kg/m$^2$) pile weight and 9/16 inch (1.4 cm) pile height.

The above results for 34 oz/sq yd (1.15 kg/m$^2$) carpets are plotted in FIG. 4 in the form of newness retention as a function of carpet bulk. The low-bulk yarn and carpets of Example 1 are considered to be part of the prior art. Carpets corresponding to points 2A' and 3A', although showing very high bulk, fall outside the invention because they were prepared from yarns of only 3.5 tpi (1.4 twists/cm), and consequently have poor newness retention. It is apparent from FIG. 4 that at a given carpet bulk the carpets constructed from yarns of the current invention in Examples 2 and 3 have a much higher newness retention rating than those of Example 1. Similarly, at a given newness retention rating, the carpets constructed from yarns of the current invention have much higher bulk than those of Example 1.

EXAMPLES 4–6

Nylon 6,6 polymer (70 RV) was spun at 290° C. through a 160 hole 1.75 MR spinneret at 67 lb/hr (30.4 kg/hr) throughput in a process similar to that used for Examples 1-2. The feed roll was operated at 785 ypm (718 m/min) and the draw roll speed was 2197 ypm (2009 m/min; 2.8 draw ratio). The bulking jet air temperature was 200° C. The yarn was cooled by air on the bulking drum from the 11 o'clock position to the 1 o'clock position. For Example 4 the hot roll temperature was 170° C., for Example 5 the hot roll temperature was 190° C., and for Example 6 the hot roll temperature was 210° C.

The yarns produced in Examples 4-6 were converted into two-ply, cable-twisted yarns having 4.75 and 5.75 tpi (1.9 and 2.3 twists/cm), Superba heatset at 270° C., and tufted into ⅛ in (0.32 cm) gauge, ½ in (1.27 cm) pile height cut-pile carpets at 32 and 40 oz/sq yd (1.09 and 1.36 kg/m$^2$) and ⅛ in (0.32 cm) gauge, ⅝ in (1.6 cm) pile height cut-pile carpets at 50 oz/sq yd (1.70 kg/m$^2$). The tufted carpets were then dyed in a continuous dye range, latexed and tip sheared in the same manner as in Examples 1-3 The finished carpets were tested for carpet bulk and newness retention. Yarn and carpet properties are summarized in Table 2.

TABLE 2

| Item | MR | Yarn % BCE | Twist (tpi) | Carpet Wt (oz/sq yd) | Carpet Bulk | NR |
|---|---|---|---|---|---|---|
| 4 A | 1.75 | 18 | 4.75 | 32 | 0.244 | 2.8 |
| 4 B | 1.75 | 18 | 5.75 | 32 | 0.185 | 3.2 |
| 4 B' | 1.75 | 18 | 5.75 | 40 | 0.239 | 3.7 |
| 4 B" | 1.75 | 18 | 5.75 | 50 | 0.265 | 3.7 |
| 5 A | 1.75 | 29 | 4.75 | 32 | 0.279 | 2.6 |
| 5 B | 1.75 | 29 | 5.75 | 32 | 0.221 | 3.6 |
| 5 B' | 1.75 | 29 | 5.75 | 40 | 0.280 | 3.8 |
| 5 B" | 1.75 | 29 | 5.75 | 50 | 0.313 | 4.1 |
| 6 A | 1.75 | 40 | 4.75 | 32 | 0.323 | 2.2 |
| 6 B | 1.75 | 40 | 5.75 | 32 | 0.261 | 3.5 |
| 6 B' | 1.75 | 40 | 5.75 | 40 | 0.320 | 3.0 |
| 6 B" | 1.75 | 40 | 5.75 | 50 | 0.375 | 3.2 |

EXAMPLES 7-9

Nylon 6,6 yarns were spun in a process similar to that used in Examples 4-6 except that a 2.5 MR spinneret was used. For Example 7 the hot roll temperature was 170° C., for Example 8 the hot roll temperature was 190° C., and for Example 9 the hot roll temperature was 210° C.

The yarns produced in Examples 7-9 were converted into two-ply cable-twisted yarns having 3.75, 4.75 or 5.75 tpi (1.5, 1.9, or 2.3 twists per cm). Superba heatset at 270° C. and tufted into ⅛ in (0.32 cm) gauge, ½ in (1.27 cm) pile height cut-pile carpets at 32 and 40 oz/sq yd (1.09 and 1.36 kg/m$^2$) and ⅛ in (0.32 cm) gauge, ⅝ in (1.6 cm) pile height cut-pile carpets at 50 oz/sq yd (1.7 kg/m$^2$). The tufted carpets were then dyed in a continuous dyeing machine, latexed, and tip sheared in the same manner as in Examples 1-3. The finished carpets were tested for carpet bulk and newness retention. Yarn and carpet properties are summarized in Table 3.

TABLE 3

| Item | MR | Yarn % BCE | Twist (tpi) | Carpet Wt (oz/sq yd) | Carpet Bulk | NR |
|---|---|---|---|---|---|---|
| 7 A | 2.5 | 18 | 3.75 | 32 | 0.300 | 1.3 |
| 7 B | 2.5 | 18 | 5.75 | 32 | 0.242 | 2.9 |
| 7 B' | 2.5 | 18 | 5.75 | 40 | 0.297 | 3.2 |
| 7 B" | 2.5 | 18 | 5.75 | 50 | 0.349 | 3.3 |
| 8 A | 2.5 | 29 | 4.75 | 32 | 0.285 | 2.0 |
| 8 B | 2.5 | 29 | 5.75 | 32 | 0.262 | 2.8 |
| 8 B' | 2 5 | 29 | 5.75 | 40 | 0.334 | 2.7 |
| 8 B" | 2.5 | 29 | 5.75 | 50 | 0.401 | 3.3 |
| 9 A | 2.5 | 35 | 4.75 | 32 | 0.338 | 1.6 |
| 9 B | 2.5 | 35 | 5.75 | 32 | 0.305 | 2.5 |

TABLE 3-continued

| Item | MR | Yarn % BCE | Twist (tpi) | Carpet Wt (oz/sq yd) | Carpet Bulk | NR |
|---|---|---|---|---|---|---|
| 9 B' | 2.5 | 35 | 5.75 | 40 | 0.376 | 2.6 |
| 9 B" | 2.5 | 35 | 5.75 | 50 | 0.442 | 3.3 |

EXAMPLES 10-12

Nylon 6,6 yarns were spun in a process similar to that used in Examples 7-9 except that a 3.4 MR spinneret was used. For Example 10 the hot roll temperature was 170° C., for Example 11 the hot roll temperature was 190° C., and for Example 12 the hot roll temperature was 210° C.

The yarns produced in Examples 10-12 were converted into two-ply, cable-twisted yarns having 4.75 and 5.75 tpi (1.87 and 2.26 twists/cm), Superba heatset at 270° C. and tufted into ⅛ in (0.32 cm) gauge, ½ in (1.27 cm) pile height cut-pile carpets at 32 and 40 oz/sq yd (1.09 and 1.36 kg/m$^2$) and ⅛ in (0.32 cm) gauge, ⅝ in (1.6 cm) pile height carpets at 50 oz/sq yd (1.70 kg/m$^2$). The tufted carpets were then dyed in a continuous dyeing machine, latexed, and tip sheared in the same manner as in Examples 1-3. The finished carpets were tested for carpet bulk and newness retention. Yarn and carpet properties are summarized in Table 4.

TABLE 4

| Item | MR | Yarn % BCE | Twist (tpi) | Carpet Wt (oz/sq yd) | Carpet Bulk | NR |
|---|---|---|---|---|---|---|
| 10 A | 3.4 | 18 | 5.75 | 32 | 0.274 | 1.9 |
| 10 A' | 3.4 | 18 | 5.75 | 40 | 0.352 | 2.1 |
| 10 A" | 3.4 | 18 | 5.75 | 50 | 0.396 | 2.2 |
| 11 A | 3.4 | 25 | 4.75 | 32 | 0.324 | 1.2 |
| 12 A | 3.4 | 31 | 4.75 | 32 | 0.339 | 1.4 |
| 12 B | 3.4 | 31 | 5.75 | 32 | 0.307 | 2.0 |
| 12 B' | 3.4 | 31 | 5.75 | 40 | 0.392 | 2.2 |
| 12 B" | 3.4 | 31 | 5.75 | 50 | 0.451 | 2.3 |

Figure 5:
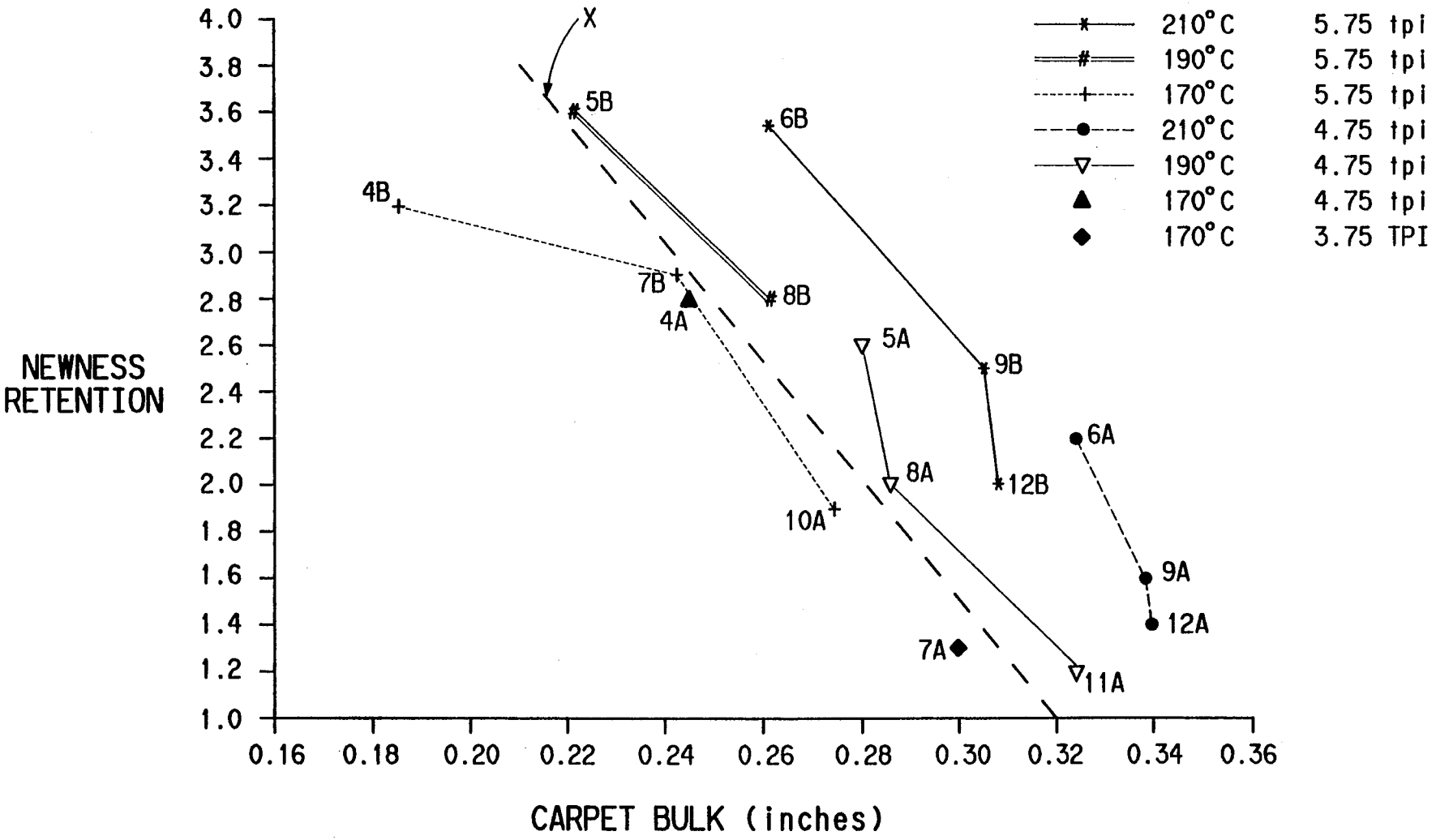
FIG. 5 is a plot of newness retention as it relates to carpet bulk, showing the balance of properties for various carpets having 32 oz/yd$^2$ (1.08 kg/m$^2$) pile weight and ½ inch (1.27 cm) pile height.
Figure 6:
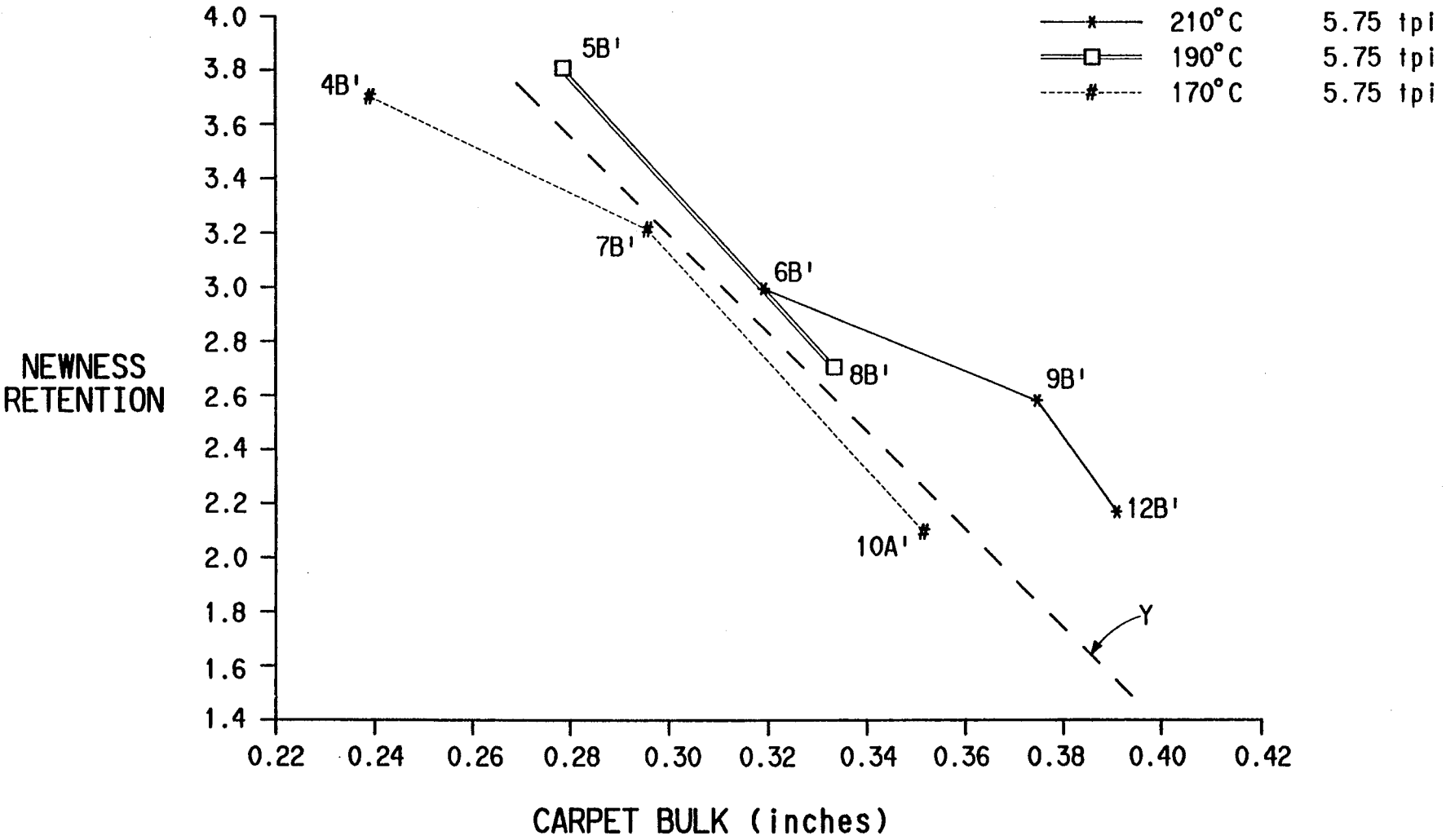
FIG. 6 is also a plot of newness retention as it relates to carpet bulk, showing the balance of properties for various carpets having 40 oz/yd$^2$ (1.36 kg/m$^2$) pile weight and ⅝ inch (1.6 cm) pile height.
Figure 7:
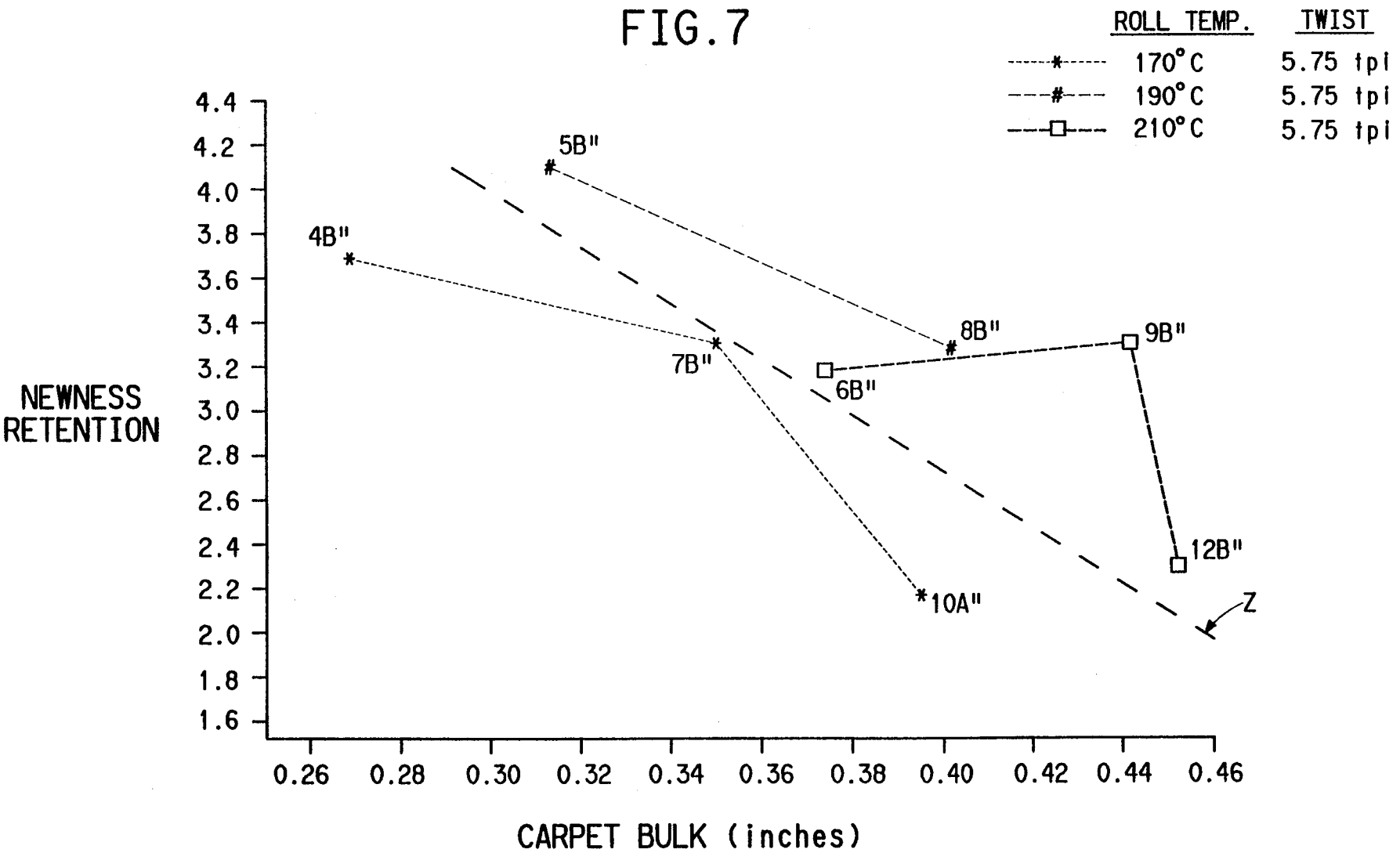
FIG. 7 is a plot of newness retention as it relates to carpet bulk, showing the balance of properties for various carpets having 50 oz/yd$^2$ (1.70 kg/m$^2$) pile weight and ⅝ inch (1.6 cm) pile height.

FIGS. 5-7 compare Examples 4-12 in three different carpet constructions using the data from Tables 2-4. In all three constructions it is observed that the control examples 4, 7, and 10 show either bulk or newness retention, or a balance of bulk and newness retention inferior to Examples 5-6, 8-9, and 11-12.

The carpet data from Examples 4-12 are plotted as newness retention versus carpet bulk in FIGS. 5-7. FIG. 5 shows data for 32 oz/sq yd (1.09 kg/m$^2$), 0.5 in (1.27 cm) pile height carpets. Each point corresponds to data for yarns processed under identical conditions and twisted to the same twist level, the points being connected to indicate a grouping at the same twist level. Each point on a line corresponds to a different MR yarn. FIGS. 6 and 7 show similar plots for 40 oz/sq yd (1.36 kg/m$^2$), 0.5 in (1.27 cm) pile height and 50 oz/sq yd (1.70 kg/m$^2$), ⅝ in (1.6 cm) pile height carpets, respectively. From each figure it can be seen that when high-bulk, high-twist yarns of the invention are used in tufting the carpet, the combination of carpet bulk and newness retention are superior to those carpets made from yarns not having high bulk and/or high twist levels.

It will be noted that a "best-fit" straight line, labelled as lines X, Y and Z respectively, can be drawn through the data on FIGS. 5-7 as an approximation of the boundary between carpets having the desired balance of carpet bulk and newness retention from those which are deficient in one or both properties. As can readily be seen, by varying yarn bulk, twist and modification ratio, carpets having a desired balance of both carpet bulk and newness retention can be obtained. Alternatively, carpets having extraordinarily high levels of either bulk or newness retention can also be obtained, one property being sacrificed to increase the other.

EXAMPLES 13–17

The yarns of Examples 13–17 were produced in a process similar to that used in Examples 1–12. The filaments were spun and quenched as per the previous examples, except that after the quench chimney they passed through an inter-floor tube approximately 8 ft (2.6 m) long, where no additional cross-flow air was used. This extended the hold-up time during the quench process to provide further cooling. In addition, the pin 5 in FIG. 3 was removed, and the two pins 5' were instead a roll and a single stationary draw pin. The yarns were spun at 76 lb/hr (34.5 kg/hr), the feed roll speed was 875 ypm (795 mpm), the speed of the draw rolls was 2624 ypm (2385 mpm), and the draw ratio was 3.0. The yarn in caterpillar form was allowed to remain on the bulking drum for a longer period of time, a vacuum of 15 inches of water, and in some cases a mist quench (80 ml/min/threadline) was used. The caterpillar take-off point was at the 5 o'clock position versus the 1 o'clock position used in the previous Examples. The take-off point was adjusted by moving the pins 12 in FIG. 3 from approximately the 5 o'clock position to approximately the 7–8 o'clock position. Table 5 summarizes the process conditions used and yarn bulk properties.

TABLE 5

| Example | Roll Temp (°C.) | Jet Temp (°C.) | Mist Quench | Yarn Bulk |
|---|---|---|---|---|
| 13 | 220 | 200 | No | 48 |
| 14 | 210 | 220 | No | 48 |
| 15 | 220 | 220 | No | 43 |
| 16 | 210 | 220 | Yes | 47 |
| 17 | 220 | 220 | Yes | 49 |

Figure 1:
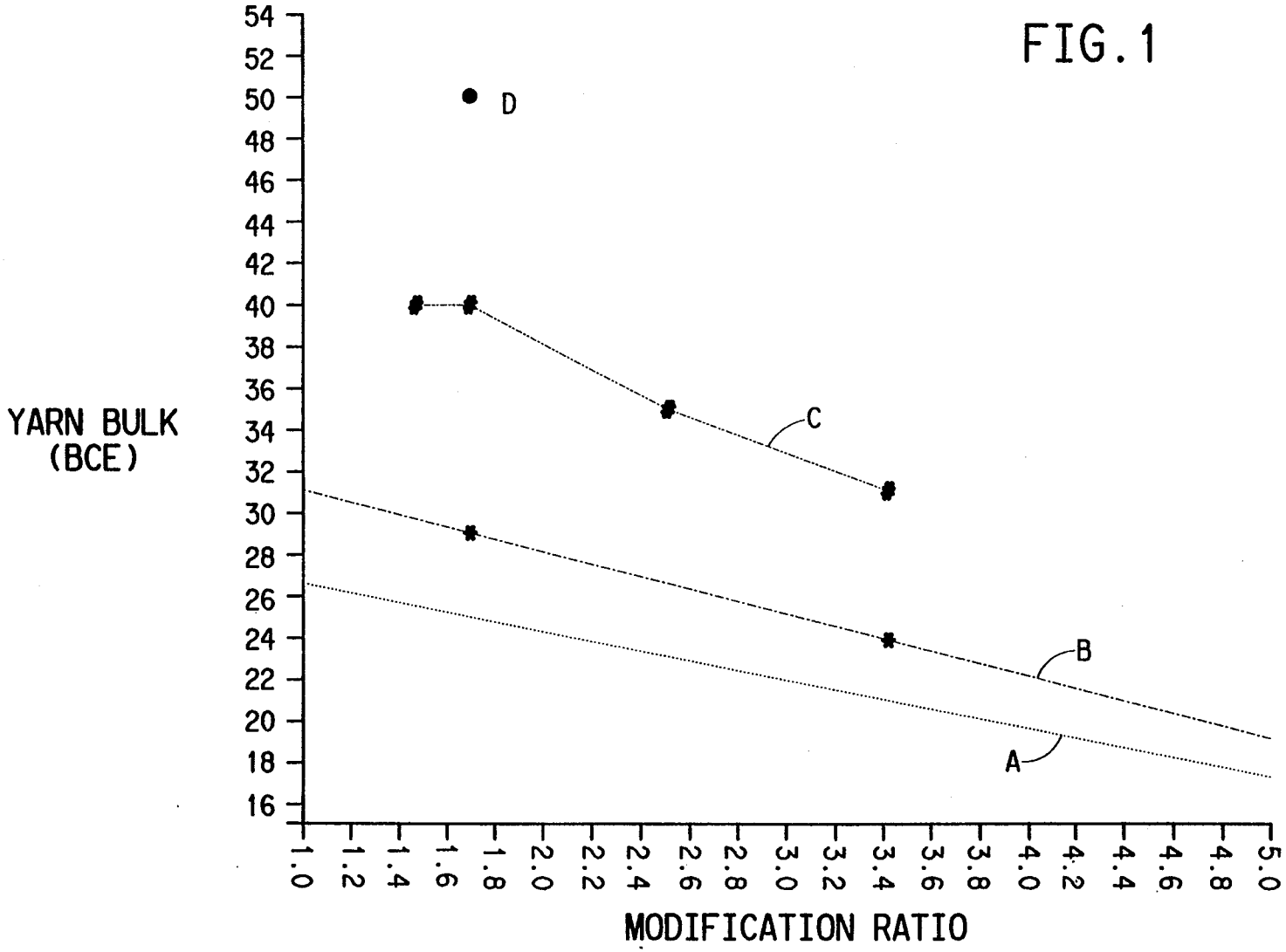
FIG. 1 is a plot of yarn bulk as it relates to modification ratio which shows bulk values for high bulk, trilobal yarns of the prior art and for new high bulk yarns as exemplified herein.

Yarn properties reported in the Examples above are plotted as yarn bulk (% BCE) versus MR in lines B and C of FIG. 1. Data for yarns produced using a draw roll temperature of 210° C. are plotted on line C (Examples 3, 6, 9 and 12). Data for yarns produced using a draw roll temperature of 190° C. are plotted on line B (Examples 5 and 11). Point D on FIG. 1 corresponds to the yarn of Example 17.

We claim:

1. Ply-twisted yarns comprised of two to four bulked continuous filament nylon ply yarns each having a denier per filament of 10–25 and a trilobal filament cross-section of modification ratio between 1.4 and 4.0 wherein the relationship between bulk level and modification ratio for each of the plies corresponds to a point on or above line B on FIG. 1 and wherein the relationship between twist level and modification ratio corresponds to a point on or above line E shown on FIG. 2.

2. Ply-twisted yarns of claim 5 wherein the relationship between bulk level and modification ratio for each of the plies corresponds to a point on or above line C on FIG. 1.

3. Ply-twisted yarns of claim 1 wherein the relationship between twist level and modification ratio corresponds to a point on or above line F shown on FIG. 2.

4. Ply-twisted yarns of claim 3 wherein the relationship between bulk level and modification ratio for each of the plies corresponds to a point on or above line C on FIG. 1.

5. Cut-pile nylon carpets having a pile weight of at least 20 ounces per square yard (0.68 kg/m$^2$) and a pile height of at least 7/16 inch (1.11 cm), the pile being tufted from ply-twisted yarns comprised of two to four bulked continuous filament nylon ply yarns each having a denier per filament of 10–25 and a trilobal filament cross-section of modification ratio between 1.4 and 4.0 wherein the relationship between bulk level and modification ratio for each of the plies corresponds to a point on or above line B on FIG. 1 and wherein the relationship between twist level and modification ratio corresponds to a point above line E shown on FIG. 2.

6. Carpets of claim 5 having a pile weight of at least 32 ounces per square yard (1.09 kg/m$^2$).

7. Carpets of claim 5 having a pile weight of at least 40 ounces per square yard (1.36 kg/m$^2$).

8. Carpets of claim 5 having a pile weight of at least 50 ounces per square yard (1.70 kg/m$^2$).

9. Carpets of claim 5 wherein the relationship between twist level and modification ratio for each of the ply yarns corresponds to a point above line F shown on FIG. 2.

10. Carpets of claim 6 wherein the relationship between twist level and modification ratio for each of the ply yarns corresponds to a point above line F shown on FIG. 2.

11. Carpets of claim 7 wherein the relationship between twist level and modification ratio for each of the ply yarns corresponds to a point above line F shown on FIG. 2.

12. Carpets of claim 8 wherein the relationship between twist level and modification ratio for each of the ply yarns corresponds to a point above line F shown on FIG. 2.

* * * * *